US007269375B2

(12) United States Patent
Van Sas

(10) Patent No.: US 7,269,375 B2
(45) Date of Patent: Sep. 11, 2007

(54) IMAGE TRANSFER DEVICE AND METHOD FOR CLEANING A PART THEREOF

(75) Inventor: Lambertus M. L. Van Sas, Helmond (NL)

(73) Assignee: OCE-Technologies B.V., Venlo (NL)

( * ) Notice: Subject to any disclaimer, the term of this patent is extended or adjusted under 35 U.S.C. 154(b) by 2 days.

(21) Appl. No.: 11/214,769

(22) Filed: Aug. 31, 2005

(65) Prior Publication Data

US 2006/0045560 A1 Mar. 2, 2006

(30) Foreign Application Priority Data

Sep. 1, 2004 (EP) ..... 04077445

(51) Int. Cl.
*G03G 15/16* (2006.01)

(52) U.S. Cl. ..... 399/101

(58) Field of Classification Search ..... 399/101
See application file for complete search history.

(56) References Cited

U.S. PATENT DOCUMENTS 4,607,947 A * 8/1986 Ensing et al. ..... 399/308
4,705,388 A 11/1987 Huntjens et al.
5,107,285 A * 4/1992 Hamada et al. ..... 347/130
6,226,489 B1 5/2001 Eelen et al.
6,487,389 B2 * 11/2002 Jia et al. ..... 399/327

FOREIGN PATENT DOCUMENTS

EP 0 944 861 B1 9/1999
JP 05072949 A * 3/1993

* cited by examiner

*Primary Examiner*—Quana Grainger
(74) *Attorney, Agent, or Firm*—Birch, Stewart, Kolasch & Birch, LLP

(57) ABSTRACT

An image transfer device for a sheet-fed image reproduction system is disclosed in which an improved removal of contaminants from the surface of an image transfer member is possible by using a tacky surface cleaning member contacting the image transfer member surface. The tacky surface of the cleaning member is rejuvenated substantially without affecting the productivity of the image reproduction system by applying predetermined patterns of cleaning substance on the image transfer member surface in the non-image areas, being the part of the inter-image areas coinciding with the inter-sheet areas. Also disclosed is a method for cleaning the image transfer member surface of such image transfer device.

10 Claims, 2 Drawing Sheets

IMAGE TRANSFER DEVICE AND METHOD FOR CLEANING A PART THEREOF

FIELD OF THE INVENTION

The present invention is directed to an image transfer device for transferring images of a marking substance, including ink and toner, from an image transfer member to a recording medium. Furthermore, the present invention is related to a method of removing debris from the surface of the image transfer member of such an image transfer device.

BACKGROUND OF THE INVENTION

Image reproduction systems, such as printers and copiers, often include an image transfer device having an image transfer member, usually in the form of a belt or a drum, for receiving on its surface a marking substance, such as toner or ink, in image form and for subsequently transferring these images of marking substance in a transfer zone to a recording medium, such as paper. In an operative state, the image transfer member is urged against a counter member in the transfer zone while the recording medium passes therebetween. The transfer may take place by means of pressure, or heat, or heat and pressure each of them optionally being assisted by electrostatic forces and/or vibrational forces. Particularly in case the marking substance is a toner, the marking substance must be fixed onto the receiving material in order to render the images permanent. By applying an appropriate amount of pressure and heat in the transfer zone, transfer and fixing take place simultaneously. Otherwise a subsequent fixing step must be executed. For example, this may be done by feeding the recording medium, onto which the unfixed marking substance is already deposited, through a fixing zone where an increased temperature and pressure serve to fix the image permanently to the recording medium.

In such image transfer devices, contaminants, e.g., in the form of residual marking substance material and/or debris originating from the recording medium and/or other impurities may build up on the surface of the image transfer member. For instance, when the recording medium is paper or a like fibrous material, debris in the form of dust and fibers may build up on the image transfer member surface in the region of the transfer zone. If these contaminants remain on the image transfer member surface, the efficiency of the image transfer and the quality of the fixing, where applicable, may be affected. Hence, it is desirable to clean the surface of the image transfer member.

It is known to provide an endless cleaning member having a tacky substance on its surface and being positioned downstream of the transfer zone for removing contaminants from the image transfer member surface when being engaged in contact therewith. It is also known that over time, the tackiness of the cleaning member is reduced and hence the surface layer of the cleaning member needs to be rejuvenated. As disclosed in U.S. Pat. No. 4,705,388 (Huntjens et al./Océ-Nederland BV) or EP 0994861 (Douvdevani et al./Indigo N.V.), this may, for instance, be done by periodically developing a non-image pattern of a tacky substance, in casu toner, on an image transfer member to rejuvenate the surface layer of the cleaning member. In such a rejuvenation state, the image transfer member with the non-image toner pattern thereon passes the transfer zone while no recording medium is supplied and without urging the counter member against the image transfer member. The non-image toner pattern on the image transfer member is guided further towards the contact zone between the image transfer member and the cleaning member, i.e. the cleaning zone. When the image transfer member with the non-image toner pattern passes the cleaning zone, the non-image toner pattern is transferred to the cleaning member surface thereby rejuvenating it. The periodic rejuvenation of the tacky surface layer as described is found to lead to inconsistent cleaning characteristics caused by the reduction of the surface tackiness when proceeding in the operative state towards the next rejuvenation period. From this perspective, it seems beneficial to implement a high rejuvenation periodicity. However, contrary to the operative state, in the rejuvenation stage no prints or copies are generated and thus a high rejuvenation period is detrimental for the productivity of the image reproduction device. These conflicting requirements demand for a new approach for rejuvenating the tacky surface of the cleaning member.

SUMMARY OF THE INVENTION

Thus it is an object of the present invention to provide a device and method in which an improved removal of contaminants from the surface of an image transfer member is possible.

It is still a further object of the present invention to rejuvenate the tacky surface of the cleaning member substantially without affecting the productivity of the image reproduction system.

It is still a further object of the present invention to rejuvenate the tacky surface of the cleaning member by providing refreshment material and simultaneously removing any excess and/or contaminated tacky surface material therefrom.

To meet these objects according to a first aspect of the invention, there is provided an image transfer device for transferring images of a marking substance to sheets of a recording medium, the device including:

an endless image transfer member for receiving consecutive images of a marking substance on its surface, the image transfer member being urged, in an operative state of the transfer device, into contact with a counter member to form a transfer zone therebetween for transferring the respective consecutive images to respective sheets of a recording medium fed consecutively through the transfer zone; and an endless cleaning member having, in an operative state of the transfer device, a surface in contact with the surface of the image transfer member in a cleaning zone downstream of the transfer zone, the surface of the cleaning member carrying a layer of tacky substance wherein a controllable applicator unit is utilized for providing, in an operative state of the image transfer device, predetermined patterns of a cleaning substance to the surface of the image transfer member in at least some of the non-image areas, the predetermined patterns of cleaning substance provided on the image transfer member being substantially completely transferred to the surface of the cleaning member in the cleaning zone. The present invention is particularly relevant to printers and copiers where, to enable printing on a wide variety of recording media, at least one image transfer device is provided to transfer an image of marking substance from an image forming device to the recording medium. The feature that non-image patterns of cleaning substance are formed in the non-image areas, i.e., the areas between consecutive images coinciding with the areas between consecutive sheets is advantageous as it allows the rejuvenation of the cleaning member surface, quasi continuously. Furthermore, as this takes place in the operative state, i.e. while sheets of recording medium are fed through the transfer zone and hence prints or copies of images are generated, this rejuvenation process does not negatively affect the productivity of the printer or copier.

The cleaning member and the counter member may be selectively movable into and out of contact with the image transfer member surface and may be independently driven. Alternately, these items can be driven by the movement of the image transfer member.

The image transfer member may be in the form of a drum or a belt and may be heated.

In case the image transfer member is a belt a first and second backing roller may be provided, the first backing roller cooperating with the cleaning member to form the cleaning zone through which the belt passes, the second backing roller contacting the back of the image transfer belt opposite the counter member such that in the transfer zone both the belt and the recording medium pass while pressure is exerted on at least one of the second backing roller and the counter member to define the contact.

The image transfer member typically has an outer layer of a silicone elastomer. The counter member typically has an outer layer of a silicone elastomer, or a PTFE, or a fluororubber. To ensure that substantially all the cleaning substance remains on the image transfer member surface in the transfer zone where both members contact each other, the outer layer of the counter member may be chosen such that it has a lower affinity to the cleaning substance than the outer layer of the image transfer member. When part of the cleaning substance transfers to the counter member surface, a cleaning member with a tacky surface may also be engaged in contact with the counter member. Alternately one can also opt to move the counter member out of contact with the image transfer member in the time interval between two consecutive sheets in order to ensure that the cleaning substance remains on the image transfer member surface in the transfer zone. However, this is less preferred as the disengagement and subsequent engagement of the counter member after each sheet negatively influences reliability and image quality, in particular image registering.

The cleaning member usually is a cleaning roller, although also a cleaning web may be used. The cleaning roller is located downstream of the transfer zone and upstream of any intermediate transfer zone where images of marking substance are transferred to the image transfer member directly from an image forming member or indirectly via one or more further image transfer members. The kind of marking substance and image forming member which is used depends on the imaging technique which is used. Examples of imaging techniques include ink jet, electrography including electrophotograpy, and magnetography. Examples of marking substance include ink, dry particulate toner, and liquid toner. For instance in the case of electrophotography, the marking substance may be a dry particulate toner, while the image forming member is a drum or a belt with a photoconductive outer layer whereon a latent image is formed and subsequently developed with toner.

The tacky surface layer material and the cleaning substance can be formed of polymeric material having good adhesive and adsorptive properties, especially at the operating temperatures of the image transfer member. Preferably, the cleaning substance comprises a polymer having a glass transition temperature below the temperature of the image transfer member at the cleaning zone. Such polymeric material may be toner, as a toner typically comprises a thermoplastic binder consisting of a thermoplastic resin or a mixture of resins including coloring matter, e.g., carbon black or coloring material such as finely dispersed pigments or soluble dyes. The toner used as the cleaning substance may be one of the toners used as the marking substance for rendering the images. Alternately, it is also possible to use toner of a different composition as a cleaning substance, for example containing a lower level of coloring material, or even no coloring material at all.

The applicator unit may be a simple dosing unit, which is able to supply fresh cleaning substance at a controllable rate and dose to predetermined locations of the moving image transfer member and according to a predetermined pattern. An example of such dosing unit is a spray coating unit. Particularly in the case where the cleaning substance is a toner or toner-like material, the controllable applicator unit may be an image forming unit. In the latter case a predetermined pattern of cleaning substance is imaged directly on the image forming member in some or each of the non-image areas. Alternately, a latent image pattern is first formed on the image forming member and subsequently developed thereon. The predetermined pattern of cleaning substance may be transferred in an intermediate transfer zone to the image transfer member directly from an image forming member or indirectly via one or more further intermediate image transfer members. Alternately, the image forming member may constitute the image transfer member. The transferred pattern of cleaning substance present on the image transfer member passes the transfer zone. The remaining part of the pattern of cleaning substance present on the image transfer member downstream of the transfer zone is transferred substantially completely to the cleaning member in the cleaning zone.

In one embodiment of the present invention, the cleaning member is a rotatable cleaning roller having a surface with a plurality of spaced-apart perforations therein for discharging any contaminants and excess cleaning substance assembled on the cleaning roller surface into a cavity in the cleaning roller. For instance, the perforations may be in the form of grooves. An advantage thereof is that the building up on the cleaning member surface of any excess tacky substance possibly mixed with contaminants is prevented. The cleaning roller may be constructed of a metal such as steel or aluminium. The cleaning roller, however, may also be made of other heat-resistant material to the extent comporting with the operating temperature thereof. Such heat-resistant materials may include heat-resistant plastics. Optionally a perforated conformable layer may be provided on the cleaning member core material. In any case, the tacky layer is formed on the cleaning member outer surface.

In a further embodiment of the present invention, means are provided for synchronizing the position of the perforations in the cleaning member and the predetermined patterns of cleaning substance disposed on the image transfer member to ensure that in the cleaning zone the cleaning substance is only present on the image transfer member surface outside the perforations. The means for synchronizing the position may include a position sensor for determining the axial position of the cleaning member.

In yet a further embodiment of the present invention, the patterns of cleaning substance on the image transfer member are such that the portions of the image transfer member surface, covered by the patterns of cleaning substance, have an area coverage in the range from 1% to 30%. It is observed that by lowering the area coverage of the exposed portions, the transfer efficiency of cleaning substance to the counter member surface in the transfer zone can be effectively reduced.

According to a second aspect of the present invention, there is provided a method of removing contaminants from the surface of an endless image transfer member of a transfer device in which, in operation, the endless image transfer member is urged into contact with a counter member to form a transfer zone therebetween through which consecutive sheets of a recording medium are fed. The method includes the steps of contacting the image transfer member surface at a cleaning zone with an endless cleaning member having a tacky surface layer of cleaning substance, thereby transfering contaminants from the image transfer member to the tacky surface; and receiving consecutive images of a marking substance on the image transfer member and transferring the respective consecutive images in the transfer zone to the respective consecutive sheets. According to the present method patterns of a cleaning substance are provided on the image transfer member in at least some non-image areas, between at least some of the consecutive images, the non-image areas being the areas between consecutive images coinciding with the areas between consecutive sheets, the non-image patterns of cleaning substance being substantially completely transferred to the surface of the cleaning member in the cleaning zone.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE INVENTION

In relation to the appended drawings, the present invention is described in detail in the sequel. Several embodiments are disclosed. It is apparent however that a person skilled in the art can imagine several other equivalent embodiments or other ways of executing the present invention.

Figure 1:
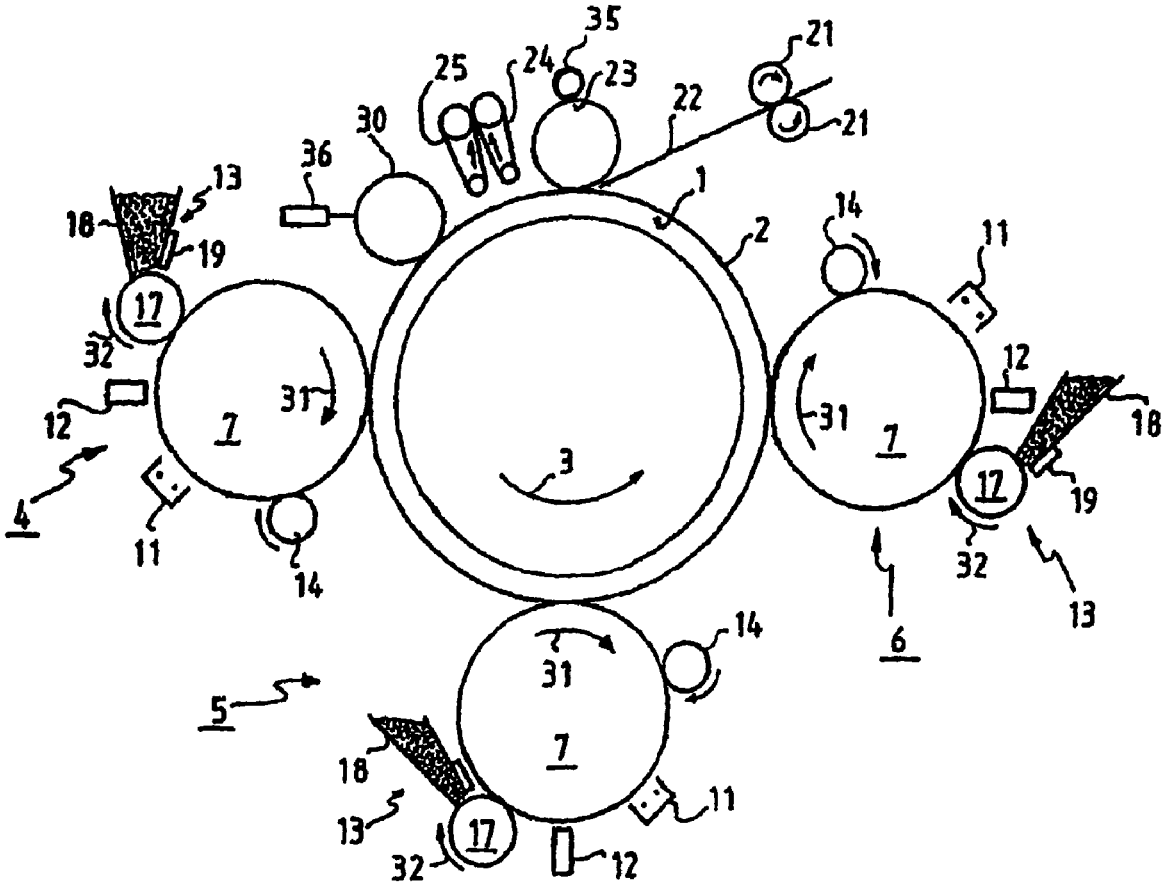
FIG. 1 is a schematic illustration of a printer according to an embodiment of the present invention.
Figure 2A:
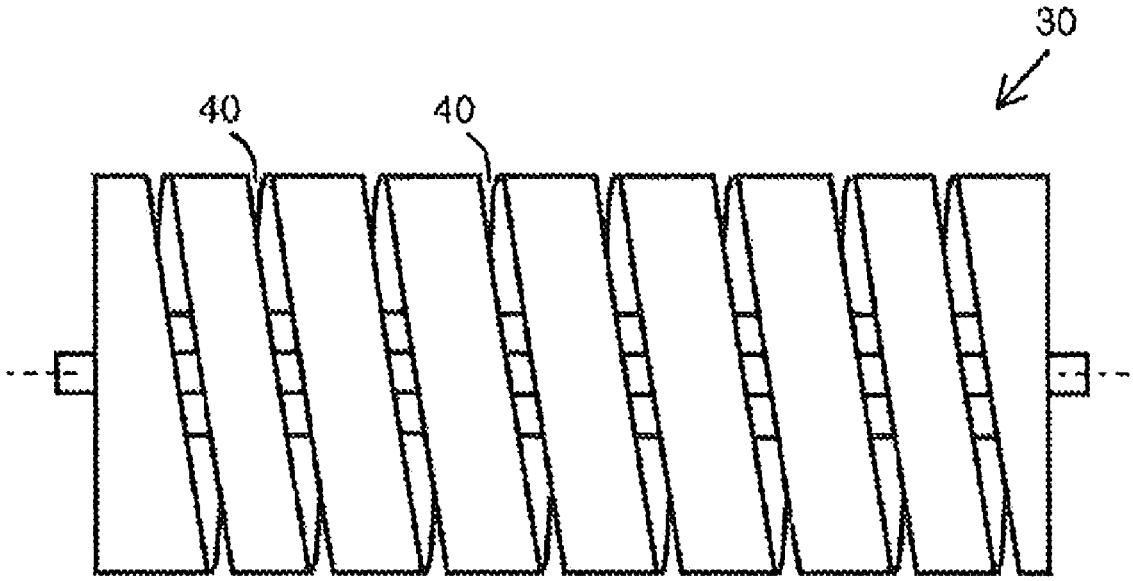
FIG. 2A is a schematic representation of the cleaning member according to an embodiment of the present invention.
Figure 2B:
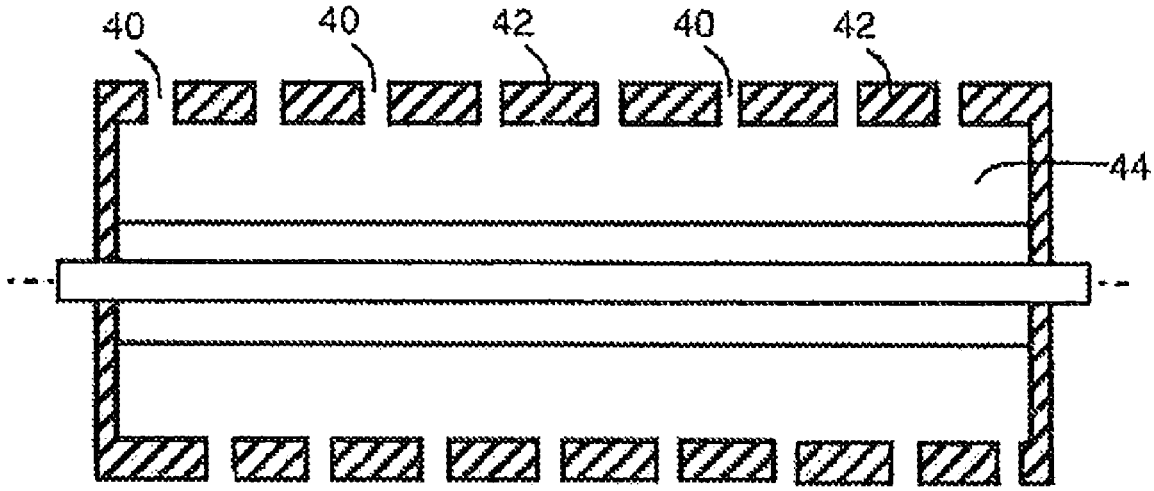
FIG. 2B is a cross-sectional view of the cleaning member.

A printing system capable of printing on sheets of a recording medium is depicted in FIG. 1. The printing system includes an image transfer member, which can be moved cyclically. The image transfer member is an endless member, such as e.g., a drum or a belt. In this case the image transfer member is a cylindrical drum 1, which can be moved in the direction of arrow 3. The image transfer member is constructed of a metal sleeve, e.g., aluminium, with an elastomeric covering 2. Optionally, the image transfer member may be provided with an outer layer of silicone rubber, e.g., by means of a coating. One or more process colors are available on the printing system dependent on whether or not it concerns a monochrome or a multi-color printing system. For each process color, an image forming unit or controllable application 4, 5, and 6 is disposed along the path of rotation of the intermediate transfer member. Each of these image forming units comprises a cylindrical image forming member 7 on which a color separation image of the corresponding process is formed. In an operative state, the image forming members are all in pressure contact with the image transfer member, the force with which the image forming members are pressed against the image transfer member being at maximum, 1000 N per linear meter, e.g., 250 N per linear meter. The cylindrical drum can be replaced with a belt and backing roller. Each image forming member is formed of a metal drum with a photo-conductive outer layer thereon, the various image forming devices being positioned along the circumference of the image forming member. These image forming devices comprise a charging device 11, e.g., a corona device, an exposing device 12, e.g., a LED array, for image-wise exposure of the photo-conductive surface to thereby form a latent charge image thereon, a development device 13 for developing the latent image with marking substance, a cleaning device 14 for removing any residual marking substance present on the image forming member after transfer of the developed separation image to the image transfer member. The development device is in this case a magnetic brush development device which includes a magnetic roller 17 containing a rotatable sleeve with a stationary magnetic system therein. The magnetic roller is positioned along the circumference of the image forming member with its surface at short distance from the image forming member surface without contacting it. A reservoir 18 with electrically conductive magnetically attractable dry particulate toner is positioned near the surface of each of the magnetic rollers 17. Each reservoir contains toner in one of the process colors. A stripper 19 is provided at each reservoir to ensure that an even layer of particulate toner is applied to the sleeve of the magnetic roller.

Also, disposed along the path of rotation of the image transfer member 1 is a rotatable counter roller 23 which is selectively movable towards and away from the image transfer member surface with controlled pressure. Means (not shown) are provided to drive this counter member. When pressing the counter member against the image transfer member surface a transfer zone is defined through which, in operation, sheets of recording medium are passed using feed means and sheet discharging means. This feed means consists of co-operating conveyor rollers 21 and a guide plate 22. The sheet discharging means includes co-operating conveyor belts 24, 25.

Further disposed along the path of rotation of the image transfer member 1 downstream of the transfer zone is a rotatable cleaning roller having a tacky surface. The cleaning roller 30 may be driven by drive means (not shown) and is selectively movable into and out-of an operative position where the cleaning member surface is in contact with the image transfer member surface. A helical perforation 40 is formed in the cleaning roller surface and extends to a cavity 44 within the roller for discharging any contaminants and/or excess cleaning substance assembled on the roller surface thereof. This helical perforation 40 defines, in the axial, direction an alternating pattern of grooves and non-perforated areas, referred to as dams 42. Although these parameters are not that critical, the width and pitch of the perforation is of importance as they determine the ratio between the cleaning and the non-cleaning area of the roller. As cleaning is only performed in the dam area and not in the grooves, proper consideration should be giving when determining these parameters. A large cleaning area is desirable but account should be taken of the fact that the contaminants and/or excess cleaning substance assembled on the cleaning roller surface dams must be able to reach the grooves. Hence, for instance the viscosity of the cleaning substance should be involved in this consideration. A position sensor (not shown) is provided to detect the axial position and optionally also the radial position of the cleaning roller as well as control means (also not shown) for controlling the position of the cleaning roller responsive to the detected position.

The tackiness of the surface layer of the cleaning roller may be improved and the viscosity of the layer may be adjusted by heating the surface layer upstream of the cleaning zone. To enable this, a heating device may be provided for heating the cleaning substance on the cleaning roller surface to render the surface tacky prior to its contact with the transfer member surface. The heating device may be in the form of a lamp located in the inner core of the roller. Alternatively, especially when the cleaning roller has a conformable surface, external heating is preferred, for example by use of an external radiant heat source. Ideally, means are provided for controlling the heating of the toner particles, for example by the use of a heat sensor to sense the temperature of the cleaning member surface, this sensor being coupled to a control device for the heating device. Heating the toner particles on the cleaning roller surface has several benefits. The heating device can be energized selectively to control the temperature and tackiness of the cleaning roller surface. This is especially beneficial at start up where, in the absence of such a heating device, it would take a significant amount of time (and possibly wastage of receiving material) before the temperature equilibrium would be reached.

In operation, in order to reproduce an image a sequence of printing signals is generated. Responsive to this sequence of printing signals the printing system sequentially forms the respective separation images of marking substance of the corresponding process color on the respective image forming members 7. In the respective pressure contact zones, the respective separation images are sequentially transferred in register to the image transfer member to thereby form a registered multi-color image thereon. The marking substance is toner, in dry particulate form. The registered multi-color toner image on the image transfer member is heated by means known per se so that the toner softens and is rendered tacky. The printing system is such that the respective separation images of marking particles are formed complementary. This means that marking particles of a process color are accumulated on the free surface of the image-carrying member and substantially not on colored marking particles already accumulated on the image-carrying member. Substantially not means that any superimposed marking particles of different process colors may not lead to visual deficiencies, i.e. visual with the naked human eye, in the finally printed image.

The printing system subsequently transfers the registered multi-color toner image to a sheet of a recording medium which is controllably fed at the appropriate time by the conveyor rollers 21 through the transfer zone defined by establishing pressure contact between the rotating image transfer member and the rotating counter member. The sheet carrying the printed image is subsequently discharged by the co-operating conveyor belts 24 and 25. The image transfer member is further advanced towards the cleaning zone where any contaminants present on its surface may be removed by transferring them to the tacky surface of the rotating cleaning roller 30. The cleaning roller 30 can be provided with a position sensor 36 to monitor the axial position of the cleaning roller. When printing consecutive images, e.g., a document of several pages and/or plural copies of a single image or document, the printing job is defined such that the consecutive images are printed each on separate sheets fed consecutively through the transfer zone. Hence, for consecutive images both an inter-image area, being the area between consecutive images carried on the image transfer member, can be defined as well as an inter-sheet area, being the distance between the associated consecutive sheets. The part of the inter-image area coinciding with the inter-sheet area is referred to as the non-image area. According to the present invention, a predetermined pattern of cleaning substance is formed in the non-image area. This may be done by imaging a predetermined pattern on the image forming member of one of the available process colors and subsequently developing it thereon with the corresponding toner. The toner, preferably black toner when available, used to form this predetermined pattern constitutes the cleaning substance. The image forming unit and the formation process of the predetermined pattern is controlled such that the transfer of the cleaning substance pattern to the image transfer member in the pressure contact zone is effected in the non-image area. When the cleaning substance pattern in the non-image area reaches the transfer zone in the interval between two consecutive sheets, it can not be transferred to a sheet but instead will remain on the surface of the image transfer member or will be (partially) transferred to the counter member surface 23. When the image transfer member is moved further to the cleaning zone the cleaning substance pattern or at least the residual part thereof will be transferred to the dams of the tacky cleaning roller surface 30 thereby rejuvenating the tacky surface layer. To ensure that substantially all cleaning substance is removed from the image transfer member surface in the cleaning zone a pattern is selected which can be synchronised with the cleaning member using the cleaning roller position detection and controlling means such that the cleaning substance is only present in the cleaning zone in the area coinciding with the dams of the cleaning roller. For example, when the pitch of the helical perforation is 3.5 mm and the groove width (dimension in axial direction) is 0.8 mm, typically a pattern is chosen having a dam width of about 1.1 mm which is well within the dam width of the cleaning roller. The dams of the pattern constitute the portions of the image transfer member surface in the non-image area covered with cleaning substance, while the dam width of the pattern is the width of the covered portions in the non-image area.

As previously stated, when a cleaning substance pattern in a non-image area reaches the transfer zone in the interval between two consecutive sheets, it will remain on the surface of the image transfer member or will be (partially) transferred to the counter member surface 23. To avoid that the cleaning substance transferred to the counter member contaminates the back of subsequent sheets and transfered back to the image transfer members surface, a tacky surface cleaning roller 35 may also be provided to clean the counter member surface. Instead of providing the additional cleaning roller or in combination with the additional cleaning roller, one can also opt to take appropriate measures to severely reduce or even nullify the transfer rate of cleaning substance to the counter member surface. One or these measures could be the use of a counter member surface layer having a lower affinity to cleaning substance compared to the image transfer member surface layer. Examples of such counter member surface layers are polyorganosiloxane layers, in particular the ones disclosed in EP0349072 (Schoustra et al., Océ Technologies B.V.). Instead of or in addition to this measure, on could also opt to lower the area coverage of the portions of the image transfer member surface in the non-image area covered by the patterns of cleaning substance, as it has been observed that this is beneficial to reduce the transfer rate of cleaning substance to the counter member surface. For instance the area coverage may be chosen typically in the range of from 1% to 30%, or from 1% to 10%, or from 1% to 5%.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image transfer device for transferring images of a marking substance to sheets of a recording medium which comprises:

an endless image transfer member provided for receiving consecutive images of a marking substance on its surface, the image transfer member being urged, in an operative state of the transfer device, into moving contact with a counter member to form a transfer zone therebetween for transferring the respective consecutive images to respective sheets of a recording medium fed consecutively through the transfer zone;

an endless cleaning member having, in an operative state of the image transfer device, a surface in moving contact with the surface of the image transfer member in a cleaning zone downstream of the transfer zone, the surface of the cleaning member carrying a layer of tacky substance; and a controllable applicator unit for providing, in an operative state of the image transfer device, predetermined patterns of a cleaning substance to the surface of the image transfer member in at least some non-image areas, the non-image areas being the areas between consecutive images coinciding with the areas between consecutive sheets, the predetermined patterns of cleaning substance on the image transfer member being substantially completely transferred to the surface of the cleaning member in the cleaning zone.

2. The image transfer device according to claim 1, wherein the cleaning member is a cleaning roller having a surface with a plurality of spaced-apart perforations therein for discharging any contaminants and excess cleaning substance collected on the cleaning roller surface.

3. The image transfer device according to claim 2, wherein the perforations are grooves.

4. The image transfer device according to claim 2, further including means for synchronizing the position of the perforations and the predetermined patterns of cleaning substance to ensure that in the cleaning zone cleaning substance is only present on the image transfer member surface outside the perforations.

5. The image transfer device according to claim 4, wherein said means for synchronizing the position includes a position sensor for determining the axial position of the cleaning member.

6. The image transfer device according to claim 1, wherein the portions of the image transfer member surface, covered by the patterns of cleaning substance, have an area coverage in the range from 1% to 30%.

7. The image transfer device according to claim 1, wherein the counter member has an outer layer of a silicone elastomer, a PTFE, or a fluororubber, and the image transfer member has an outer layer of a silicone elastomer.

8. The image transfer device according claim 1, wherein the image transfer member is in the form of a belt and the cleaning member cooperates with a backing roller to form the cleaning zone through which the belt passes.

9. The image transfer device according to claim 1, wherein said cleaning substance includes a polymer having a glass transition temperature below the temperature of the surface of the image transfer member in the cleaning zone.

10. The method of removing contaminants from the surface of an endless image transfer member of an image transfer device, in which, in operation the endless image transfer member is urged into contact with a counter member to form a transfer zone therebetween, through which consecutive sheets of a recording medium are fed, which comprises:

contacting the image transfer member surface in a cleaning zone with an endless cleaning member having a tacky surface layer of cleaning substance, thereby transfering contaminants from the image transfer member to the tacky surface; and receiving consecutive images of a marking substance on the image transfer member and transferring the respective consecutive images in the transfer zone to the respective consecutive sheets; and providing patterns of a cleaning substance on the image transfer member in at least some non-image areas, between at least some of the consecutive images, the non-image areas being the areas between consecutive images coinciding with the areas between consecutive sheets, the non-image patterns of cleaning substance being substantially completely transferred to the surface of the cleaning member in the cleaning zone.

* * * * *